United States Patent [19]

Patthey

[11] 4,237,706

[45] Dec. 9, 1980

[54] INTARSIA KNITTING MACHINE

[75] Inventor: Michel Patthey, Couvet, Switzerland

[73] Assignee: Edouard Dubied & Cie, Couvet, Switzerland

[21] Appl. No.: 22,315

[22] Filed: Mar. 20, 1979

[30] Foreign Application Priority Data

Apr. 12, 1978 [CH] Switzerland ..... 3902/78

[51] Int. Cl.[3] ..... D04B 15/52; D04B 15/56; D04B 15/64

[52] U.S. Cl. ..... 66/126 R; 66/128; 66/127

[58] Field of Search ..... 66/125 R, 126, 126 A, 66/127, 128, 64, 129, 131, 136, 137

[56] References Cited

U.S. PATENT DOCUMENTS 2,602,312 7/1952 Zimic et al. ..... 66/128

4,052,865 10/1977 Zamarco ..... 66/128

FOREIGN PATENT DOCUMENTS 551851 6/1932 Fed. Rep. of Germany ..... 66/128

2459693 6/1975 Fed. Rep. of Germany ..... 66/126 R

*Primary Examiner*—Ronald Feldbaum

*Attorney, Agent, or Firm*—Lewis H. Eslinger

[57] ABSTRACT

A knitting machine includes a knitting carriage, guide bars for thread guides having plunging yarn hook/feeders and a thread guide control device. A control device is integral with the knitting carriage. The control device cooperates with at least one thread guide formed of a cam having faces defining at least three different plunging levels and actuating the plunging yarn hook/feeders located on its pathway, independently of the direction of motion of the knitting carriage.

6 Claims, 6 Drawing Figures

INTARSIA KNITTING MACHINE

The present invention relates to knitting machines and in particular to a knitting machine adapted to knit an Intarsia pattern.

Knitting machines of the Intarsia type have been previously proposed, such as for example, the one described in German Patent DT-AS No. 2459 693. The machine shown in that patent, however, limits the plunging yarn hook/feeders' operating efficiency due to a wait or dwell time, at the end of a stroke which is required in order to allow the yarn hook/feeder to take up yarn. More specifically, that German patent discloses a machine which includes a device acting on the thread guides which are driven by a knitting carriage and having no means of acting on those thread guides that are temporarily out of action.

In accordance with the present invention a simple device is provided which is easy to fit on existing machines, making it possible to obtain all Intarsia patterns, even with looped yarns. This is achieved by a device which acts on all of the thread guides used in connection with the article to be knitted, regardless of whether or not a specific thread guide is placed in action or not in the knit course considered. This makes it possible to obtain Intarsia patterns, even if distant from one another, without the floating threads being able to constitute a manufacturing drawback or defect.

The above, and other objects features and advantages of this invention will be apparent in the following detailed description of a presently preferred embodiment of the invention when read in connection with the accompanying drawings, wherein.

Figure 1:
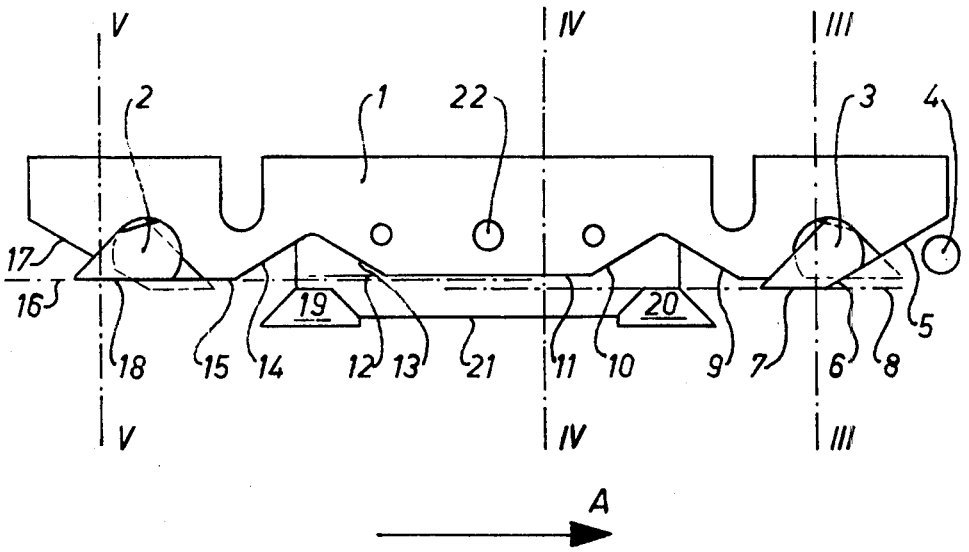
FIG. 1 is a front view of a yarn hook/feeder's control device constructed in accordance with the present invention.

Referring now to the drawing and initially to FIG. 1, a yarn hook/feeders' control device constructed in accordance with the present invention is shown which comprises a cam 1 having pivoting tongues 2, 3 pivotally mounted thereon in any convenient manner for movement between the solid and dotted line positions thereof illustrated in the drawing. Cam 1 is mounted in a known knitting carriage, not shown, by conventional means, that are also known and not shown to move with the knitting carriage in a reciprocating motion transversely with respect to the needles of the machine. For descriptive purposes, the knitting carriage is assumed to move from left to right in the drawing, in the direction indicated by arrow A, and the cam 1 moves with it. The cam is located to cooperate with bolts 4, integrally formed on each yarn hook/feeder, as described in connection with FIG. 2. For the sake of clarity in the drawing only one bolt 4 is illustrated in FIG. 1.

Cam 1 has a first plunging or driving ramp 5 adopted to engage bolt 4 and extend its associated thread guide. Ramp 5 is extended by a ramp 6 defined by one edge of pivoting tongue 3. The latter also includes a flat cam face 7 that extends parallel to the path of travel A of the cam which defines a first thread guide plunging level 8.

Down stream of tongue 3 in the direction of travel A of cam 1, the cam includes a rising ramp surface 9, followed by a plunging or driving ramp surface 10, a flat face 11 which defines a second thread guide plunging level 12, a rising ramp 13, a plunging ramp 14, a flat face 15 defining a third thread guide plunging level 16 and a rising ramp 17. The pivoting tongue 2 has a flat face 18 located in superimposed alignment with the extension of face 15 on plunging level 16.

Limiting or safety cams 19, 20, rigidly mounted on a plate 21 attached to cam 1 by fastening means or bolts 22, have edge surfaces facing the rising ramps 9 and 13 of cam 1 to ensure a rising motion of bolt 4 away from the plunging levels to which it is driven by the plunging ramps 5 and 10.

When the carriage moves in the direction opposite to that indicated by arrow A, tongues 2 and 3 are moved by engagement with bolt 4 and assume the positions indicated by dotted lines. The geometry of the cam, and hence that of the pathway of bolt 4, is thus similar to that described above, as seen in the direction of motion of the said bolt.

Figure 2:
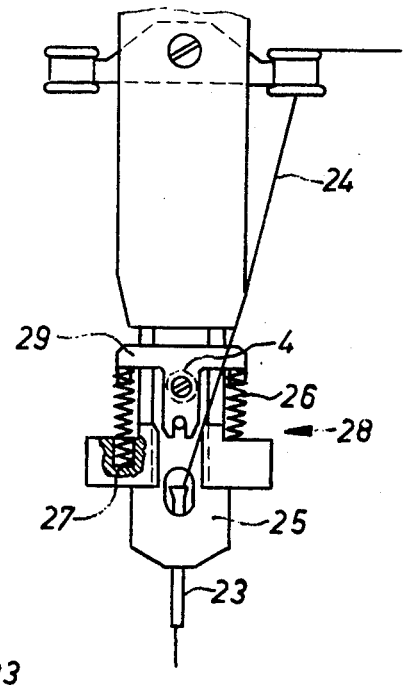
FIG. 2 is a partial front view of a yarn carrier used in a knitting machine containing the control device of the present invention.

The yarn carrier used with the present invention is shown in FIG. 2 and includes a tube 23 through which yarn 24 passes. The tube is integral with or fixed to a slide or link 25 behind which bolt 4 is located. Under the effect of the compression springs 26 bearing against a stop 27 integral with yarn hook/feeder 28 on the one hand, and against the end 29 of slide 25 on the other hand, the said yarn hook/feeder and thus bolt 4 is always biased towards and brought back into high position. The cam 1 of FIG. 1 acts on bolt 4 to drive the bolt against the effect of springs 26 in order to move the guide tube to the various thread guide plunging levels.

The function of the various plunging levels 8, 12, 16 is described in connection with FIGS. 3, 4 and 5.

Figure 3:
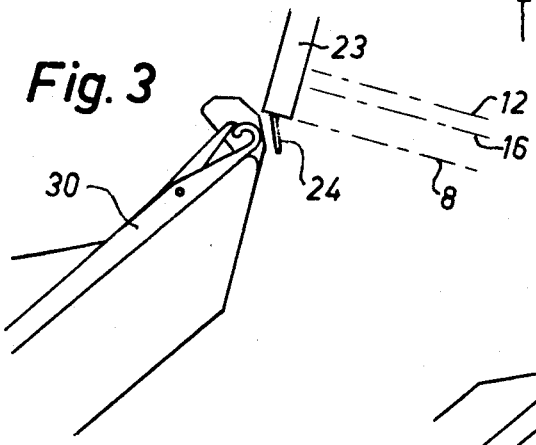
FIG. 3 is an enlarged schematic view of the position of a thread guide tube with respect to the needles of the knitting machine where the control device operates on the thread guide tube at the level of the line III—III of FIG. 1.

The schematic view of FIG. 3 is a partial cross section of the needle bed of the knitting machine at the level of line III—III of FIG. 1, and it shows the position of tube 23 with respect to the needles 30 of one needle bed when bolt 4 of yarn hook/feeder 28 is at the plunging level 8 defined by face 7 of cam 1. In this plunge phase, yarn 24 is positioned in a precise manner between two neighboring needles 30 at the lowest level in order to allow the raised needle to pass over the yarn. This position is all the more important as the distance separating two work fields of one and the same color, knitted with the same yarn hook/feeder, is large, in order to ensure the position of yarn 24 under the needle upon long movements of the yarn hook/feeders that previously resulted in the appearance of long floating threads.

Figure 4:
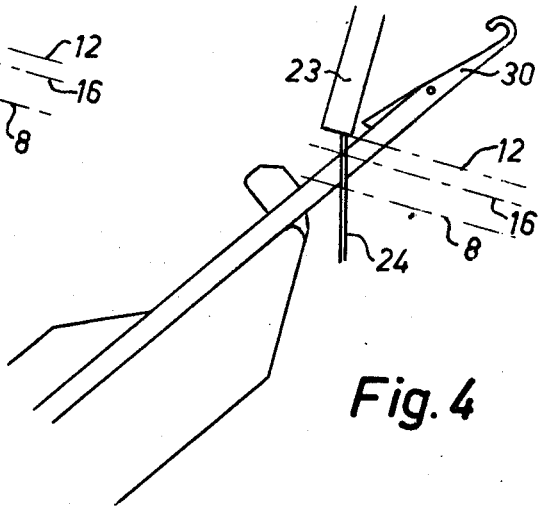
FIG. 4 is an enlarged schematic view of the position of a thread guide tube with respect to the needles where the control device operates on the thread guide tube at the level of the line IV—IV of FIG. 1.

The partial cross section view of FIG. 4 is similar to FIG. 3 but draws the relationship of the needles and thread guide tube where bolt 4 engages cam 1 at the level of line IV—IV of FIG. 1. This shows the position of tube 23 with respect to needles 30 when bolt 4 of yarn hook/feeder 28 is on the plunging level 12 defined by face 11 of cam 1. At this state tube 23 is positioned between two needles so that it be sufficiently low to make sure that in the last rising phase 31 (see FIG. 6) of the needle the closed latch of the needle does not stitch into the yarn while, at the time of the first knitting cam system clearing phase 32 (see FIG. 6) of the needle, the open latch is not closed by a fibril or loop of such a yarn, as this would unavoidably result in a drop stitch in the knit.

Figure 5:
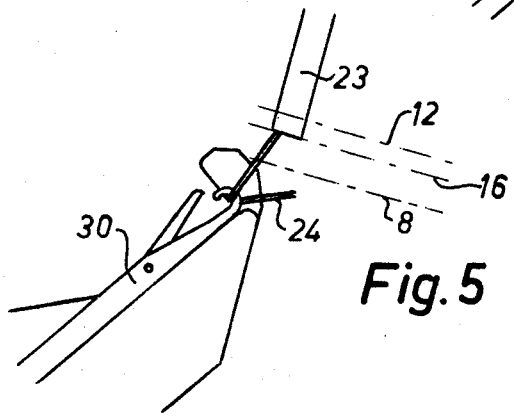
FIG. 5 is an enlarged schematic view similar to FIGS. 3 and 4 showing the position of the various elements where the control device operates on the thread guide tube at the level of the line V—V of FIG. 1.

The partial cross section view of FIG. 5 shows the relationship of the needles and thread guide tube where bolt 4 engages cam 1 at the level of line V—V of FIG. 1. This shows the relative positions of the tube and of the needle when bolt 4 is in plunging level 16 defined by face 18 of cam 1. In this position, the yarn hook/feeder is maintained in a sufficiently low position such as to ensure the placing of the yarn in the needle hook for a sufficiently long time to prevent the yarn from escaping from the needle hook before it is held by the closed latch.

Figure 6:
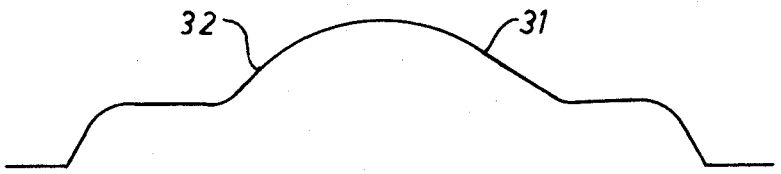
FIG. 6 is a schematic representation of the rise curve of the needles with respect to the cam of FIG. 1.

FIG. 6, is arranged opposite FIG. 1, to show the position of the rise curve of the needles with respect to cam 1. It should be noted that the plunging movements of the yarn hook/feeder occur when the latter is in the stop position.

In operation the carriage drives the yarn hook/feeder along in a known, conventional manner, not described within the scope of the present invention, when bolt 4 arrives at the top of ramp 13, the bolt will remain in this position until the yarn hook/feeder arrives at the end of its stroke. Thereupon, the bolt follows the profile of cam 1 defined by ramp 14, face 18 and ramp 17.

A distinction must be made between the cases of two yarn hook/feeders, either in action or out of action. The yarn hook/feeder which is not to be placed in action upon knitting the course considered will not remain at the top of ramp 13 and will continue its plunging motion controlled by ramp 14. It is absolutely necessary that the yarn hook/feeders which are out of action follow the same plunging motions, in order to avoid knitting errors that may appear when the yarn conducted by these yarn hook/feeders is on the path of the needles being raised.

In the knitting machine of the present invention ramps 9 and 10 perform a function only in the direction opposite the direction of motion of the carriage. They position the yarn hook/feeder sufficiently high so that it be carried along the carriage without entering into contact with the needles.

Accordingly, it is seen that as a result of the present invention, the knitter has available to him a simple machine without limitations that enables him to obtain all type of Intarsia patterns. Such a machine will include as many devices in accordance with FIG. 1 as it includes guide bars for thread guides.

Although an illustrative embodiment of the present invention has been described herein in connection with the accompanying drawings, it is to be understood that this invention is not limited to that precise embodiment and that various changes and modifications may be effected therein by one skilled in the art without departing from the scope and spirit of this invention.

What is claimed is:

1. A flat knitting machine for the manufacture of an Intarsia knit, comprising a plurality of needles, a knitting carriage, a plurality of thread guides each including a movably mounted plunging yarn hook/feeder having a yarn guide tube, and plunging yarn hook/feeder control means mounted on said knitting carriage for movement integrally with the latter and acting on the plunging yarn hook/feeders of all of said thread guides for selectively displacing each said yarn guide tube between a plurality of relative levels with respect to the needles of the machine regardless of whether one of said thread guides is temporarily inactive in the knitting operation.

2. A knitting machine as defined in claim 1, wherein said control means comprises a cam mounted for reciprocal transverse motion in said machine relative to said needles.

3. A knitting machine as defined in claim 2, wherein each yarn hook/feeder has a bolt mounted thereon and said cam has at least three different surface portions defining three different thread guide plunging levels relative to said needles, said surface portions acting on at least one bolt of the yarn hook/feeders.

4. A knitting machine as defined in claim 3, wherein said cam has two pairs of spaced diverging ramps defining respective intermediate positions for positioning said at least one bolt during simultaneous movement of the knitting carriage and a thread guide.

5. A flat knitting machine for the manufacture of an Intarsia knit, comprising a plurality of needles;

a movable knitting carriage;

a plurality of thread guides each including a movably mounted plunging yarn hook/feeder having a yarn guide tube and a bolt, each of the bolts being adapted to cause the respective yarn guide tube to move relative to said needles; and plunging yarn hook/feeder control means mounted on said knitting carriage for movement integrally with the latter and acting on the plunging yarn hook/feeders of all of said thread guides for selectively displacing each said yarn guide tube between a plurality of relative levels with respect to the needles of the machine, said control means including a cam mounted for reciprocal transverse motion in said machine relative to said needles, said cam having at least three different surface portions defining three different thread guide plunging levels relative to said needles, said surface portions acting on at least one bolt of said yarn hook/feeders for causing the respective yarn guide tubes to move relative to said needles, and said cam further having at least two tongues pivotally mounted thereon for movement between two distinct positions by said at least one bolt in correspondence with the direction of motion of the knitting carriage.

6. A knitting machine as defined in claim 5 wherein said tongues have two distinct surface portions respectively defining two different plunging levels in the two distinct positions thereof.

* * * * *